US005249756A

United States Patent [19]

Biagiotti

[11] Patent Number: 5,249,756

[45] Date of Patent: Oct. 5, 1993

[54] APPARATUS FOR CHANGING THE FREQUENCY OF MOTION OF A PUSHER

[75] Inventor: Guglielmo Biagiotti, Capannori, Italy

[73] Assignee: Fabio Perini S.p.A., Lucca, Italy

[21] Appl. No.: 689,629

[22] Filed: Apr. 23, 1991

[30] Foreign Application Priority Data

Apr. 27, 1990 [IT] Italy ..... 9373 A/90

[51] Int. Cl.[5] ..... B65H 19/26; B65H 19/30

[52] U.S. Cl. ..... 242/56 R; 242/66; 242/56.8

[58] Field of Search ..... 242/56.8, 66, 56 R, 242/56 A

[56] References Cited

U.S. PATENT DOCUMENTS 4,487,377 12/1984 Perini ..... 242/56.8

*Primary Examiner*—John M. Jillions

*Attorney, Agent, or Firm*—Francis J. Bouda

[57] ABSTRACT

An apparatus for changing the frequency of motion of a core-pusher device for a rewinder in relation to the feeding speed of the web material to be wound, includes a mechanism for the actuation of the pusher which is kinematically connected to the driven shaft of an epicyclic gear train which includes two driving shafts and a driven shaft. A first driving shaft of the gear train in kinematically connected to a member rotating at a speed proportional to the feeding speed of the web material, and the second driving shaft of the gear train is kinematically connected to a correction motor.

14 Claims, 3 Drawing Sheets

APPARATUS FOR CHANGING THE FREQUENCY OF MOTION OF A PUSHER

BACKGROUND OF THE INVENTION

Summary of the Invention

An apparatus for changing the frequency of motion of a core-pusher device for i rewinder in relation to the feeding speed of the web material to be wound, comprises means for the actuation of the pusher which are kinematically connected to the driven shaft of an epicyclic gear train which includes two driving shafts and a driven shaft. A first driving shaft of said gear train is kinematically connected to a member rotating at a speed proportional to the feeding speed of the web material, and the second driving shaft of said gear train is kinematically connected to a correction motor means.

DESCRIPTION

The invention relates to an apparatus able to change the frequency of motion of a pusher member, while maintaining the introduction speed steady. In particular, the invention relates to a pusher for the introduction of cores into a rewinder for the formation of rolls or logs of ribbon-like or web paper material.

In the following, reference is made in particular to a core pusher for rewinders, but the apparatus disclosed herebelow and in the claims may have also different applications whenever it is necessary to modify the frequency of motion of a first member with respect to the motion of other mechanical members which make up the machine wherein the first is inserted, without changing the speed at which the first member is moved.

The invention relates also to a rewinder with an apparatus of the above-mentioned type, and a method for modifying the length and/or the number of perforations on a web wound in a roll, by using an apparatus of the above-mentioned type.

In the rewinders for the formation of logs of ribbon-like material, means are provided defining a nip wherein there is inserted a core on which subsequently a predetermined quantity of ribbon-like material is wound, which material may be perforated or not along tear lines, for the subsequent production, for example, of rolls of toilet paper, all-purpose wiper and the like. Irrespective of the means used to carry out the winding, which may comprise a system of cylinders forming a nip, a system of belts, a combination of cylinders forming like, the cores are normally belts and cylinders or the like, the cores are normally inserted into the nip wherein the winding begins by means of an oscillating or rotating pusher member, whose oscillation or rotation is driven by a kinematic chain comprising, for example, cam members which determine the motion of the pusher, and thus the insertion of the core, after a predetermined length of web has been wound on the log in the course of formation.

The known rewinders may comprise cutting means, for example, in the form of a roller and counter-roller, to cut the web at the end of the winding of a log and to start the winding of the next log. In this case, the core must be inserted into the winding space so as to be positioned correctly with respect to the leading edge of the cut web. In other cases, no specific means are provided for the cut and, at the end of the winding of a roll, it is the core itself, introduced in due time and in correspondence of, a perforation line, which causes the tearing of the web, for example, by cooperating with the surface of one of the cylinders defining the nip for the insertion of the said core.

The systems currently used are particularly rigid, inasmuch as they do not allow a programming of the pusher motion except by mechanical means. Moreover, once the motion of the pusher has been programmed, it is extremely difficult, other parameters being left unchanged, to change the rate of introductions—that is to say, the frequency of the pusher motion while maintaining the motion of the same pusher unchanged during the insertion phase; since, to this end, it is necessary to dismount a cam system, together with the relevant transmission, and replace the system. In particular, in the production of logs of paper material or the like, as well as in other applications, it would be suitable, instead, to have the possibility of easily and rapidly adapting (possibly without stopping the machine) said introduction frequency in order, for example, to vary the length of material being wound on the individual roll and/or the number of perforations on each roll in case of perforated paper. In case of perforated ribbon-like material, the relative position between a perforation line and a newly-inserted core is of particular importance in that the tearing of the ribbon-like material, before starting the winding of a new roll, must take place in correspondence of a perforation line. The device for controlling the pusher must, therefore, ensure a high accuracy during the insertion phase of the core to ensure a correct working of the rewinder.

It is an object of the invention to provide an apparatus which allows the operating frequency of a pusher to be changed and possibly programmed in a simple and rapid manner, also without stopping the machine wherein the pusher is applied.

It is a further object of the invention to provide a rewinder comprising members for feeding a ribbon-like material, members defining a winding space and a pusher member for the insertion of cores into said space, wherein the frequency of operation of said pusher may be easily changed and programmed, also without stopping the machine.

Substantially, an apparatus for changing the frequency of motion of a core-pusher for a rewinder, with respect to the feeding speed of the ribbon-like material to be wound, comprises, according to the invention, means for driving the pusher which are kinematically connected to the driven shaft of an epicyclic gear train including two driving shafts and a driven shaft, a first driving shaft of said gear train being kinematically connected to a member rotating at a speed proportional to the feeding speed of the ribbon-like material, and the second driving shaft of said gear train being kinematically connected to a correction motor means.

In practice, the epicyclic gear train may be a differential; the gear casing of the differential is kinematically connected to the member rotating at a speed proportional to the feeding speed of ribbon-like material (N); and the correction motor means is kinematically connected to one of the axles of said differential, while the other of said axles is connected to a means for the actuation of the pusher.

The pusher may be of rotating type or of oscillating type and driven by a cam kinematically connected to the driven shaft of the gear train.

To the roller rotating at a speed proportional to the feeding speed of the ribbon-like material, an encoder or other speed sensor may be associated, able to provide a signal according to which the rotation speed of the correction motor is determined.

More generally, the invention relates to an apparatus for modifying the frequency of motion of a pusher member by leaving motion of the pusher unchanged during its active phase, comprising a source of uniform motion from which the input motion to an epicyclic gear train is derived. The driven shaft of said epicyclic gear train being kinematically connected to members for driving said pusher member, the second driving shaft being kinematically connected to a correction motor means whose rotation determines a modification in the frequency of operation of the pusher member. This apparatus may be applied to rewinders, but it may be effectively used also in other applications where similar problems may arise.

The invention also refers to a rewinder comprising means which define a space for the formation of a roll of ribbon-like material on a core, and a pusher member for the insertion of the cores into said space, characterized by comprising an apparatus as set forth above, for the control of the pusher motion.

Further embodiments of the rewinder according to the invention are indicated in the attached claims.

The invention also refers to a method for modifying the length of a wound ribbon-like material, or the number of perforations in a web wound on a core in a rewinder, with means for the insertion of the core into the winding region, characterized in that the length of the wound web is modified by, changing the motion of the core pusher means with respect to the feeding motion of the ribbon-like material.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
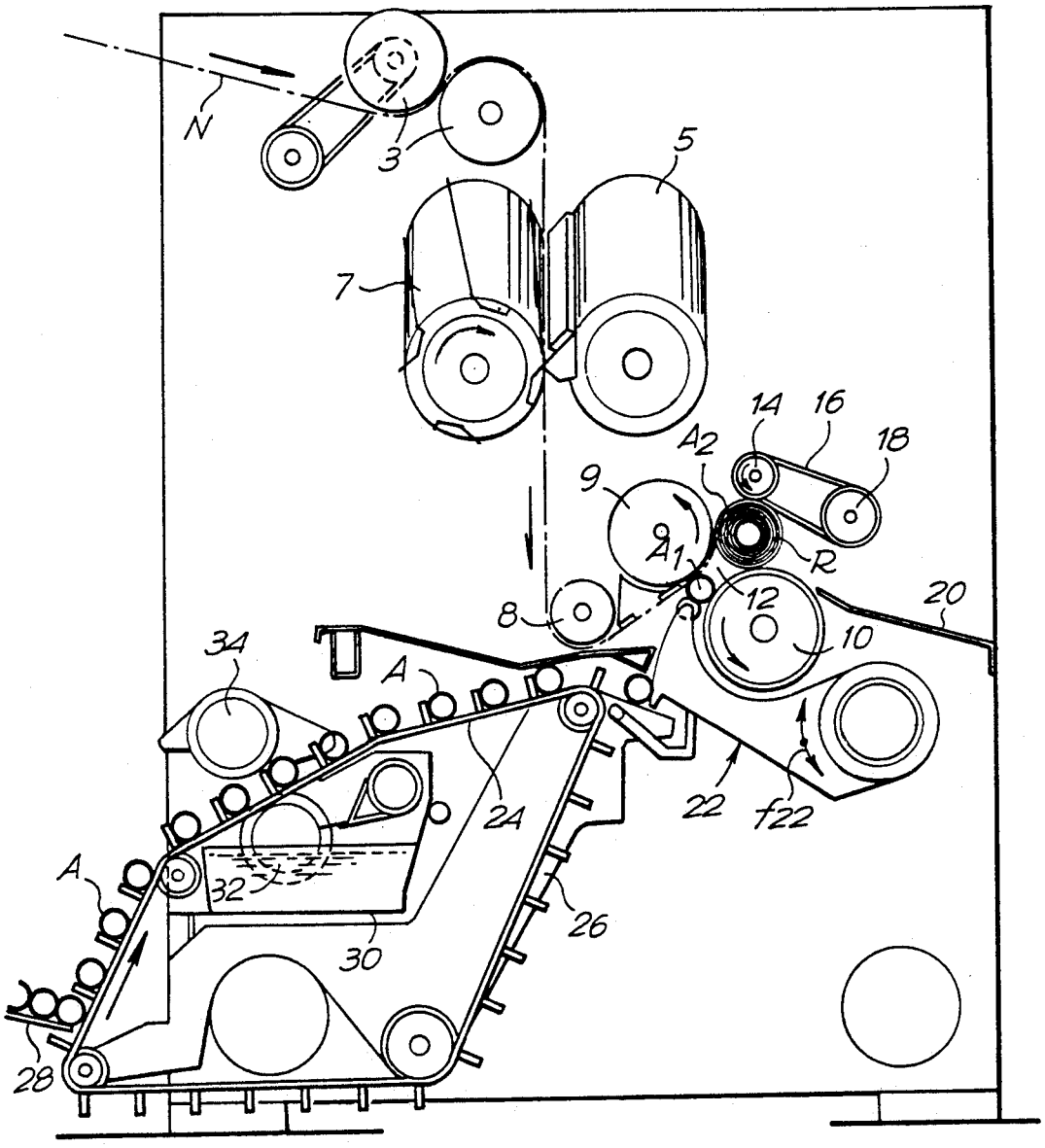
FIG. 1 shows a schematic side view of a rewinder in which the apparatus according to the invention may be applied.

Schematically shown in FIG. 1 is a type of rewinder on which the apparatus according to the invention could be possibly applied. It will be appreciated, however, that the same apparatus may be applied also on rewinders of different type.

Indicated by numeral 3 in FIG. 1 are two rollers for feeding a web N of material to be wound in rolls, such as paper for all-purpose wiper, toilet paper or the like. Numerals 5 and 7 indicate a counter-roller and a cutting roller which are intended to provide a series of perforations on the web being spaced apart a predetermined constant distance and defining the tear lines. Downstream from the perforation unit 5, 7, there is provided a cylinder 8 which moves the web N towards a nip 12 formed by two winding rollers indicated by 9 and 10. A roller 14 carried by an arm 16 pivoted at 18 defines, along with the rollers 9 and 10, a space wherein a log R of ribbon-like material is formed. The mobile roller 14 is also intended to control the diameter of the log in the course of formation and to cause, in a known manner, the discharge of the formed log along a surface 20. The core A1, which is to be introduced within the nip 12 (up completion of the log R being wound on the preceding core indicated by A2) is pushed into the nip 12 by a pusher 22 oscillating in the direction of arrow f22. When the core A1, is introduced into the nip 12, the web between the log R and the core A1 is torn so that the winding of a new roll may be started with the anchorage of the leading free edge of the web N on the core A1. The introduction of the core must take place with precise timing so as to ensure a correct mutual positioning between the core and the perforations on web N. Thus the tearing will occur in correspondence of the perforation and the free edge of the web anchored on the core on which an adhesive has been spread. The tearing of the web may take place in various ways, for example, as described in the Italian patent application No. 9436 A/89, or in the Italian patent application No. 9448 A/89, as well as in the Italian patent application No. 9519 A/81 (corresponding to the German patent application DE-A-32 25 518). Provision may also be made for the web to be cut upstream the nip 12 instead of being torn, as described, for example, in the Italian patent application No. 9502 A/81 (corresponding to the German patent application DE-A-32 17 628). The content of the above-mentioned patent applications is incorporated in the present description.

The cores A are fed to the winding region by a continuous conveyor 24 defining a plurality of seats 26 for receiving the cores A picked up from a core container 28. Associated to the conveyor 24 is a tank 30 of adhesive, with a roller 32 and a counter-roller 34 for the application of annular strips of adhesive onto the cores transported by the conveyor 24.

Figure 2:
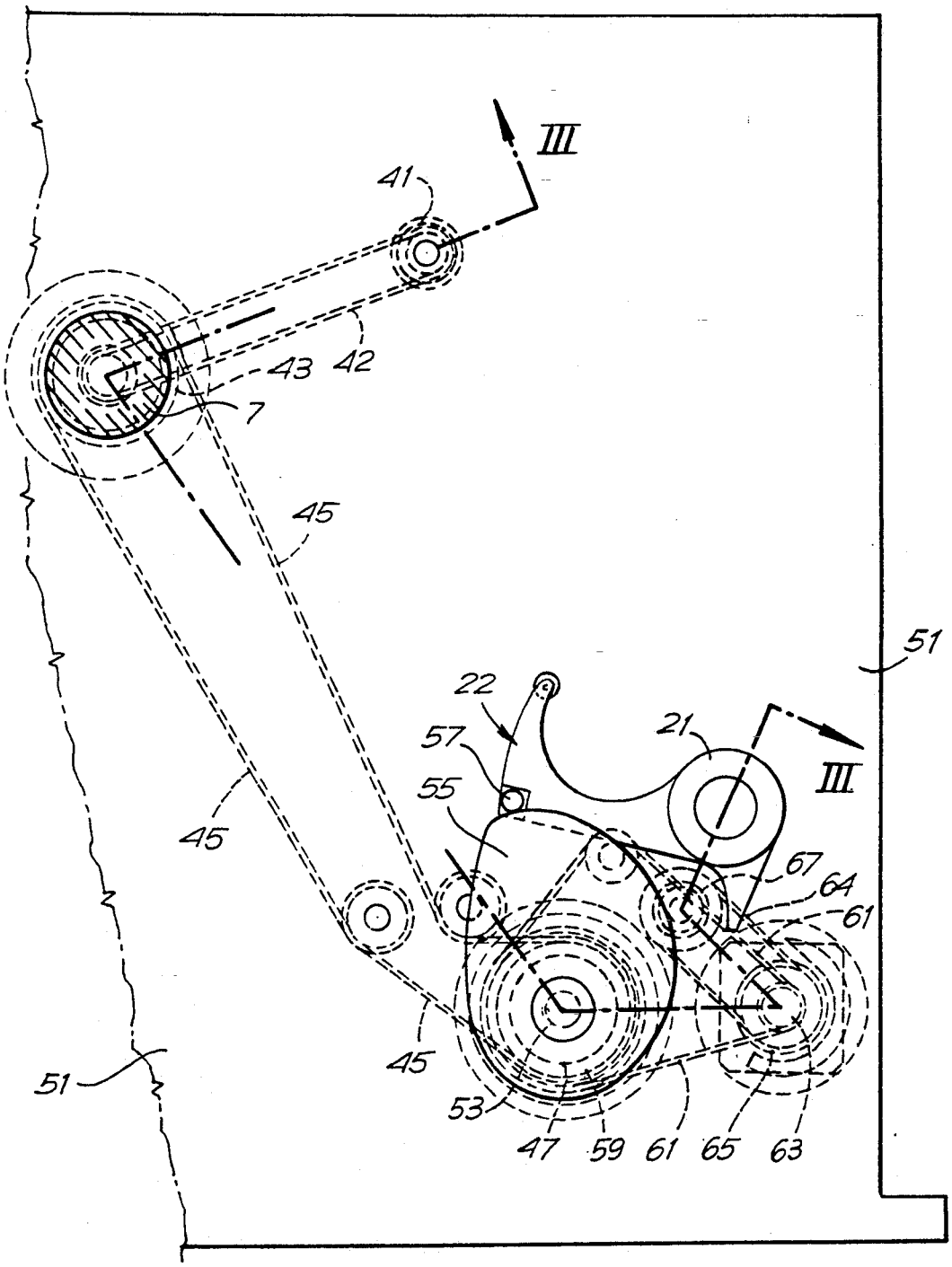
FIG. 2 shows diagrammatically the device for driving the pusher of a rewinder of the type shown in FIG. 1.
Figure 3:
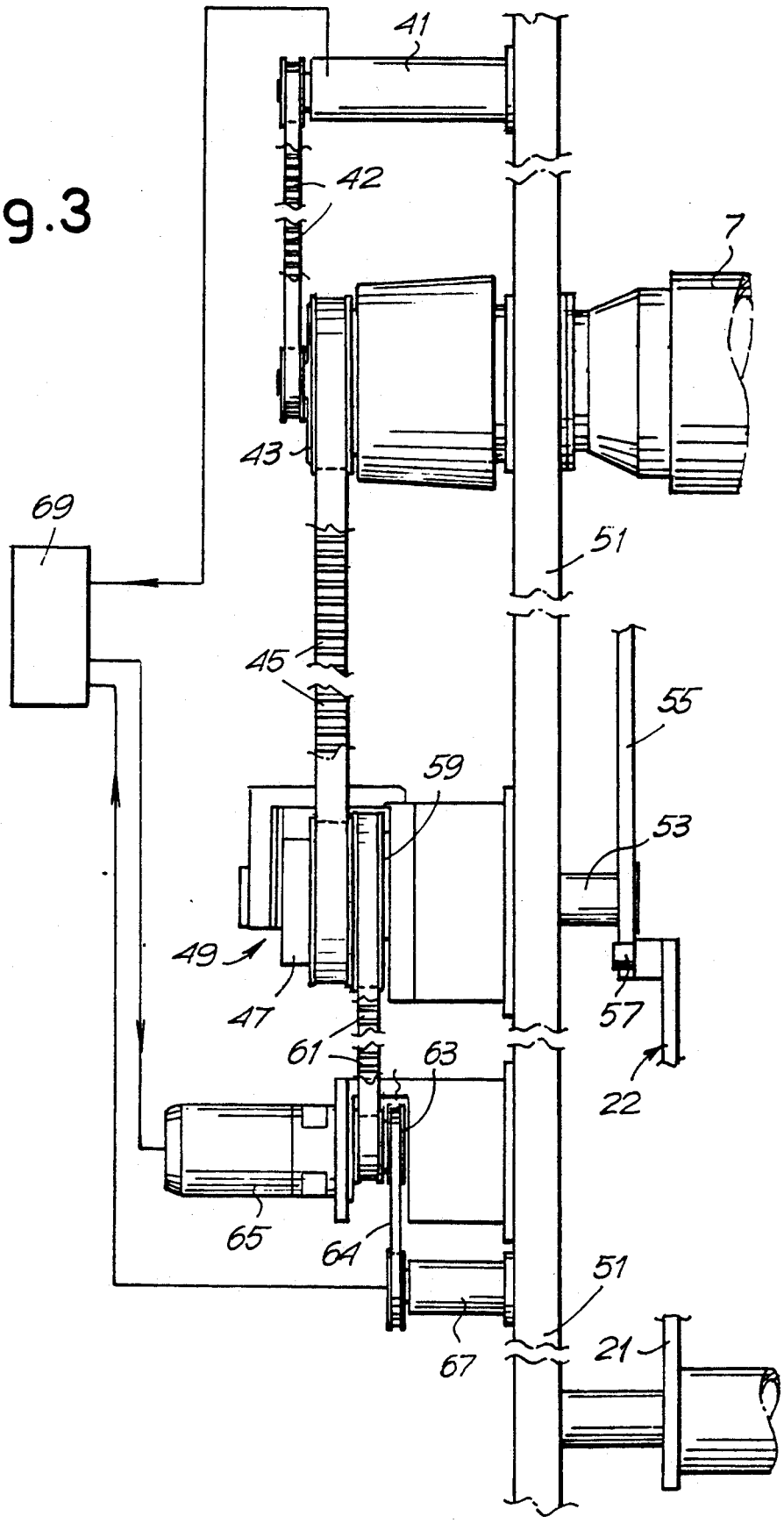
FIG. 3 shows a section view taken on the broken line III—III of FIG. 1.

FIG. 2 schematically shows the apparatus according to the invention being applied to a rewinder having a construction of the type shown in FIG. 1, while FIG. 3 shows an illustrative section taken on line III—III of FIG. 2.

As can be seen in these figures, to the perforation roller 7, an encoder 41 is associated, which determines (depending on the application) the number of revolutions of the roller 7 and thus the number of perforations carried out 6A the web N, and/or the length of the web being fed, and/or the rotation speed of the roller 7.

Driven around a toothed pulley 43 fixed to roller 7 is a toothed belt 45 which transmits the motion to the gear casing 47 of a differential 49 supported by the frame 51 of the rewinder. The gear casing 47 of the differential 49 rotates, therefore, at a speed strictly depending on the rotational speed of the perforation roller 7. A first output axle 53 of the differential 49 is connected, through a reducer (not shown), to a cam 55 with which a follower 57 borne by the pusher 22 is made to cooperate for driving the oscillation of the said pusher 22.

On the second axle of the differential 49 a toothed pulley 59 is keyed on which there is entrained a toothed belt 61 which is further entrained on a toothed pulley 63 keyed-on the take-off shaft of a motor 65 which is carried by the frame 51. Associated to the motor 65 is an encoder 67 which detects the number of revolutions and fractions of revolution of the said motor 65.

The operation of the apparatus is as follows: When the axle connected to the motor 65 is at a standstill, the gear ratio between the axis 53,, on which the came 55 is keyed, and the perforation roller 7 is pre-set to such a value as to cause an oscillation of the pusher 22 after a pre-determined number of perforations, i.e., after the winding of a pre-determined length of web on the log R. The profile of the cam 55 and the speed of the shaft 53 are such as to determine a correct introduction of the core into the nip formed by the winding rollers 9 and 10. By indicating the rotation speed of the differential casing with W, which speed is rigidly dependent on the rotational speed of the perforation rollers 7 and 9 and thus on the web feeding speed, and indicating the rotation speeds of the two differential axles with w1 and w2, the following relation exists:

$$W = Aw1 + Bw2 \qquad \text{(I)}$$

wherein A and B are real numbers depending directly on the internal ratio of the differential. It thus results that the speed of the first axle on which the cam 55 is keyed depends on the rotational speed of the second axle which is mechanically connected to the motor 65.

If, during a winding cycle, the motor 65 is driven into rotation for a pre-determined number of revolutions, there occurs a temporary variation of the rotation speed of the second axle and thus, automatically (according to equation I, wherein W remains constant) , a variation of the rotational speed of the first axle and, thereby, also of cam 55. Since, on the other hand, the angle of rotation performed by the cam 55 is determined by the integral of the rotational speed, it then results that the arc traveled on the whole by the cam 55 over the unitary time may be made to vary through the rotation of the motor 65 and thus of the second axle of the differential 49. That is to say, the time necessary to complete a revolution of the cam 55, which corresponds to the time elapsed between the insertion of a core and the insertion of the next one, may be modified through the motor 65.

Since, on the other hand, the speed of the web N being fed is constant, this variation corresponds to a variation in the length of the web wound on an individual roll and/or to a variation in the number of perforations on an individual roll. Therefore, when it is desired to wind on the roll being formed an amount of web greater or less than that resulting from the transmission ratio between the perforator roller 7 and the cam 55, when the motor 65 is not rotating, it is sufficient to drive the motor 65 into rotation, between two subsequent insertions at a number of revolutions and/or fraction of revolution, and each revolution or fraction of revolution of said motor will cause an increment or decrement (depending on the direction of rotation of the motor 65*e*) of the material wound on the roll in the course of formation.

In this way, it is possible to program any length of web, as given by the transmission ratio between the roller. 7 and cam 53 and by the correction (positive or negative) provided by the motor 65. To have all the logs equal to each other, the correction is to be performed upon every winding cycle. In order not to modify the motion of the pusher during the insertion, it is necessary that the correction takes place when the pusher 22 has completed an introduction, or when it is in the low position, that is, in the position in which it receives the new core from the conveyor 26 and in which the roll in progress is not yet completed.

To this end, it will be sufficient that the motor 65 be put into rotation when the follower 57 has just passed the highest point of the profile of cam 55. The control signal which starts the motor 65 may be obtained in any way as long as it is suitable to reach the above end. It is important, however, that the correction be ended before the pusher 22 begins the next upwardly directed oscillation.

Since the ribbon-like material may be fed at different speeds and since, therefore, the time interval between the insertion of two successive cores may vary, it is possible to provide, to prevent the correction may be the motor 65 from being too slow or too fast, that the rotational speed of the said motor 65 be controlled according to the speed of roller 7 detected by the encoder 41.

With the use of a microprocessor, diagrammatically indicated by 69, or of other suitable means, it is then possible to program the motion of motor 65 and, as, a consequence, the number of perforations and/or the length of web wound on each roll R in the course of formation in the rewinder. The encoders 41 and 67 supply the necessary input data. When it is desired to change the length of wound web or the number of perforations on the wound web, it is sufficient to transmit the new winding parameters to the microprocessor 69. The machine, starting from the cycle next to the entry of the new parameters, and with no need of stopping the apparatus or other interventions, will produce rolls corresponding to the new parameters being set.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to, indicate the scope of the invention.

Having thus described my invention what is claimed as new and desired to protect by Letters Patent are the following:

1. An apparatus for changing the frequency of motion of a core-pushing device for a rewinder in relation to the feeding speed of the web material (N) to be wound, comprising means (55) for the actuation of the pusher (22), which are kinematically connected to the driven shaft (53) of an epicyclic gear train (49) which includes two driving shafts and a driven shaft, a first driving shaft of said gear train being kinematically connected,to a member (7) rotating at a speed proportional to the feeding speed of the web material (N) , and the second driving shaft of said gear train being kinematically connected to a correction motor means (65).

2. An apparatus according to claim 1, wherein: the epicyclic gear train (49) is a differential; the differential case (47) is kinematically connected to the member (7) rotating at a speed proportional to the feeding speed of the web material (N) ; and the correction motor means (65) is kinematically connected to one of the axles of said differential, while the other of said axles is connected to a means (55) for the actuation of the pusher (22).

3. An apparatus according to claim 1 or 2, wherein the pusher (22) is driven by a cam (55) kinematically connected to the driven shaft (53) of the gear train.

4. An apparatus according to one of claims 1 or 2, wherein an encoder (67) which detects the number of revolutions of the member is connected to the correction motor means (65).

5. An apparatus according to one of claims 1 or 2, wherein an encoder (41) which detects the number of revolutions is connected to the member (7) wherein the member is a roller rotating at a speed proportional to the feeding speed of the web material (N).

6. An apparatus according to any one of claims 1 or 2, comprising programmable means for controlling the motion of the member (7) rotating at a speed proportional to the feeding speed of the web material (N).

7. A rewinder comprising means (9, 10, 14) defining a space (2) for the formation of a log (R) of web material (N) on a core (A2) and a pusher member (22) for the insertion of the cores into said space (12), including an apparatus for changing the frequency of the motion of the pusher member in relation to the feeding speed of the web material (N), said apparatus including means (55) for the actuation of the pusher member (22) which are kinematically connected to the driven shaft (53) of an epicyclic gear train (49) which includes two driving shafts and a driven shaft, a first driving shaft of said gear train being kinematically connected to a member (7) rotating at a speed proportional to the feeding speed of the web material (N), and the second driving shaft of said gear train being kinematically connected to a correction motor means (65).

8. A rewinder according to claim 7, wherein perforator means (7, 9) are provided for carrying out perforations on said web material, said epicyclic gear train (49) deriving its motion from said perforator means (7, 9).

9. A rewinder according to claim 7 or 8, wherein one of said members 7, 9 which is disposed along the path of the ribbon-like material (N) and rotates at a speed proportional to the feeding speed of the web material includes an encoder (41) able to detect the feeding speed of the web material, and which supplies a signal for controlling the rotational speed of said correction motor means (65).

10. A rewinder according to one of claims 7 or 8, wherein the pusher member (22) is provided with oscillating motion and is driven by a rotating cam.

11. A rewinder according to one of claims 7 or 8, wherein the pusher member is provided with rotary motion.

12. A rewinder according to one of claims 7 or 8 wherein there are provided two winding rollers (9, 10) forming the space (12) for the insertion of the core, and a third roller (14) for controlling the diameter of roll (R).

13. A method for changing the length of a ribbon-like material (N) wound on a core in the winding region of a rewinder, comprising the steps of:

providing a first and a second winding cylinder forming a nip therebetween;

feeding a web through said nip to said winding cylinders;

providing a core insertion means to insert a core into said nip;

providing a roll rotating at a speed proportional to the speed of the web;

providing a transmission means between said roll and said core insertion means;

winding a predetermined length of web onto said core, to form a log;

inserting a new core into said nip, separating the web and starting winding of anew log onto said new core;

during winding of each log, termporarily varying the transmission ratio of said transmission means between said roll and said core insertion means, to change the operation frequency of the core insertion means with respect to the motion of the web.

14. A method for changing the number of perforation lines in a web material (N) wound on a core (A) in the winding region of a rewinder, comprising the steps of:

providing a first and a second winding cylinder forming a nip therebetween;

feeding a web through said nip to said winding cylinders;

providing a core insertion means to insert a core into said nip;

providing a roll-rotating at a speed proportional to the speed of the web;

providing a transmission means between said roll and said core insertion means;

winding a predetermined length of web onto said core, to form a log;

inserting a new core into said nip, separating the web and starting winding of a new log onto said new core;

during winding of each log, temporarily varying the transmission ratio of said transmission means between said roll and said core insertion means, to change the operation frequency of the core insertion means with respect to the motion of the web.

* * * * *